United States Patent [19]

Kinshofer

[11] 4,405,167

[45] Sep. 20, 1983

[54] CLAMSHELL

[76] Inventor: Alfred Kinshofer, Wendelsteinstrasse 8, 8160 Miesbach/BRD, Fed. Rep. of Germany

[21] Appl. No.: 238,060

[22] Filed: Mar. 2, 1981

[51] Int. Cl.[3] ..... B66C 3/02

[52] U.S. Cl. ..... 294/70; 37/187

[58] Field of Search ..... 294/70, 88, 106; 37/183 R, 187, 188; 414/624, 626

[56] References Cited

U.S. PATENT DOCUMENTS

| | | | |
|---|---|---|---|
| 376,424 | 1/1888 | Barrows | 37/187 |
| 1,376,847 | 5/1921 | Williams | 37/187 |
| 2,621,428 | 12/1952 | Billings | 294/70 X |
| 3,413,029 | 11/1968 | Donovan | 294/70 |
| 3,774,954 | 11/1973 | Taguchi et al. | 294/70 |

FOREIGN PATENT DOCUMENTS

| | | | |
|---|---|---|---|
| 234609 | 5/1960 | Australia | 294/70 |

*Primary Examiner*—Johnny D. Cherry
*Attorney, Agent, or Firm*—Howard C. Miskin

[57] ABSTRACT

A clamshell comprises a U-shaped halfscoop carrier, two halfscoops pivoted to the legs of the half-scoop carrier on axes which are parallel to each other and to the central crosspiece connecting the legs, and actuating levers, which are secured to the half-scoops and to which the piston rod and the cylinder, respectively, of a transversely extending hydraulic actuator are pivoted at the free ends of the levers. The tubes connecting the top edges of the side walls of the half scoops are formed adjacent to their ends with radial slots extending over part of their periphery. The end portions of the T-shaped legs are provided with the bearing bores and extend through the radial slots. The side walls are formed with bores, which are aligned with the bores of the tubes and with the bearing bores and receive the pivot pins for the halfscoops.

7 Claims, 7 Drawing Figures

Figure 1:
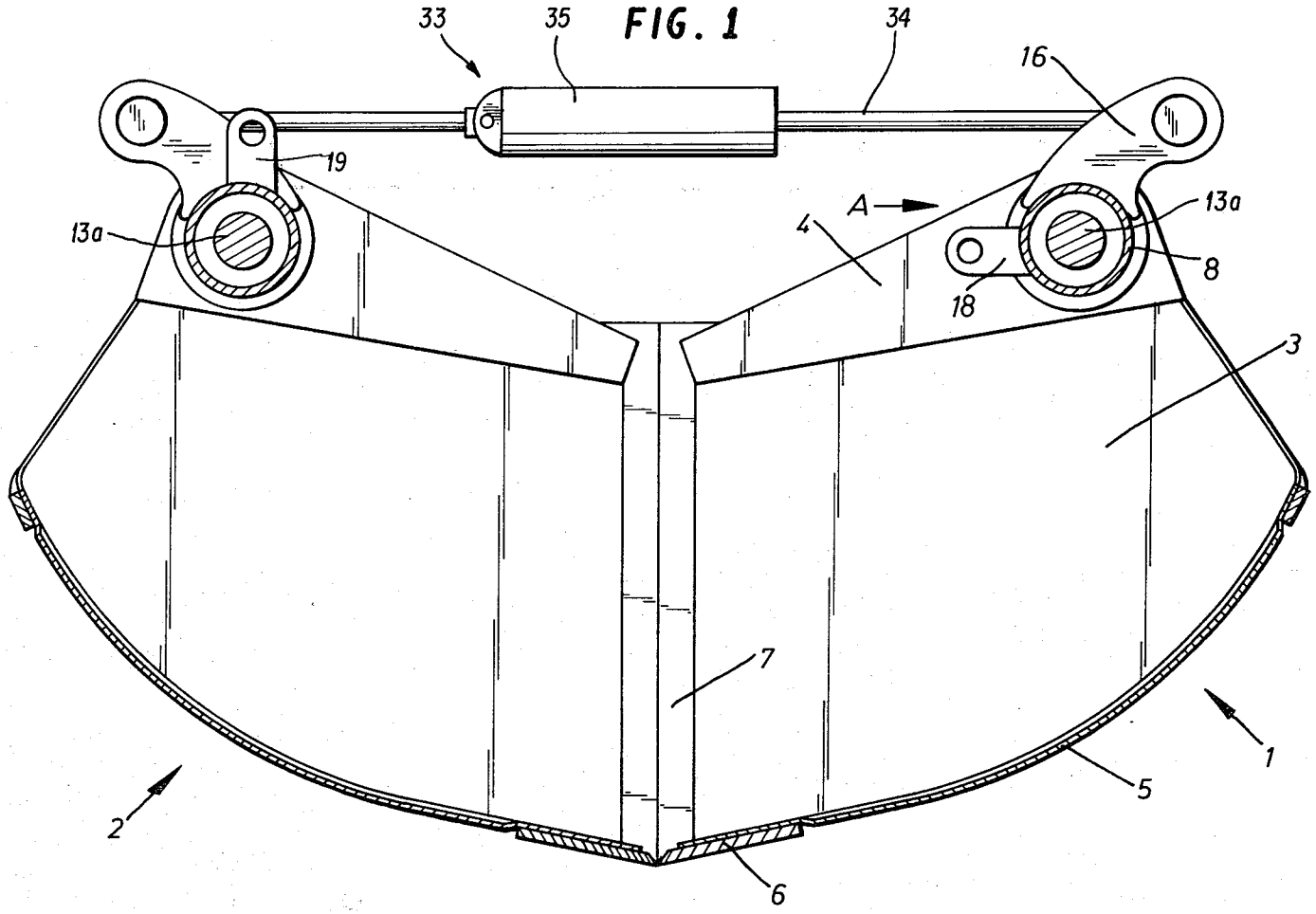

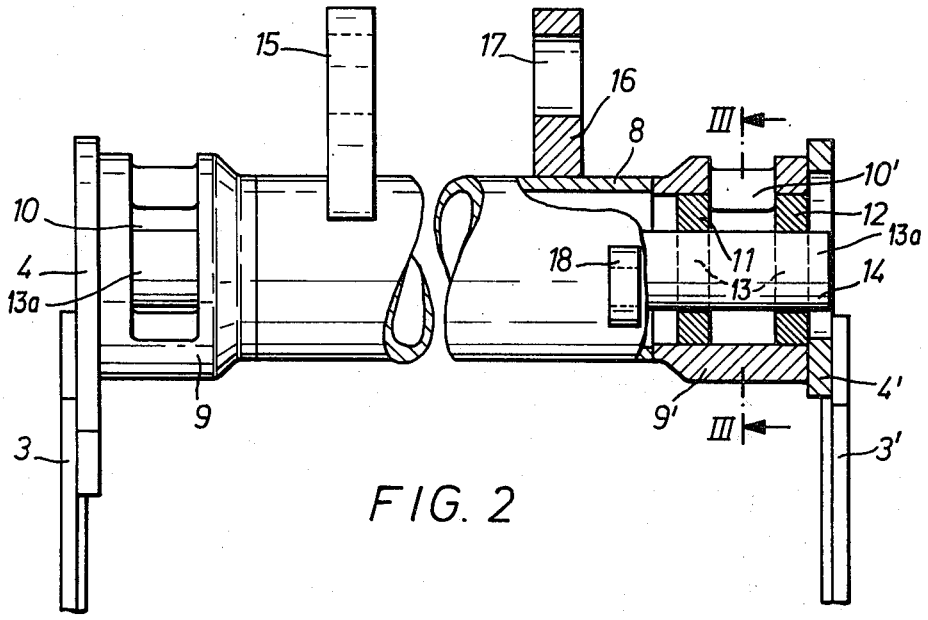
FIG. 2
FIG. 3
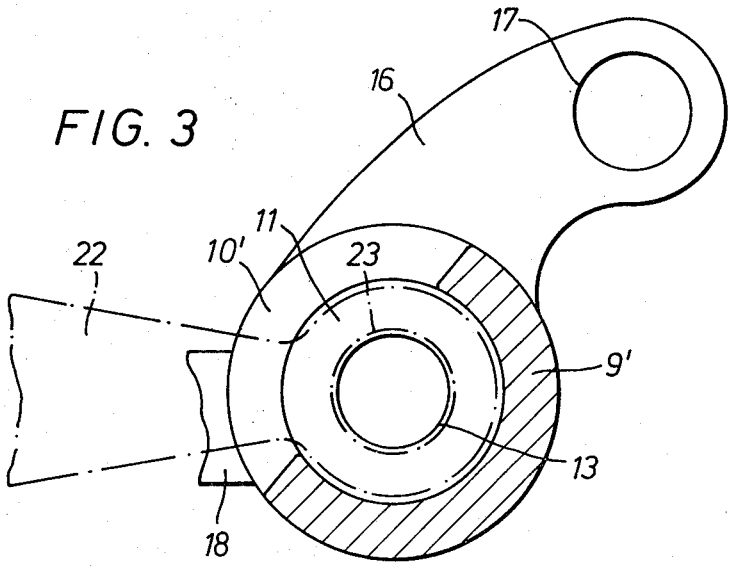

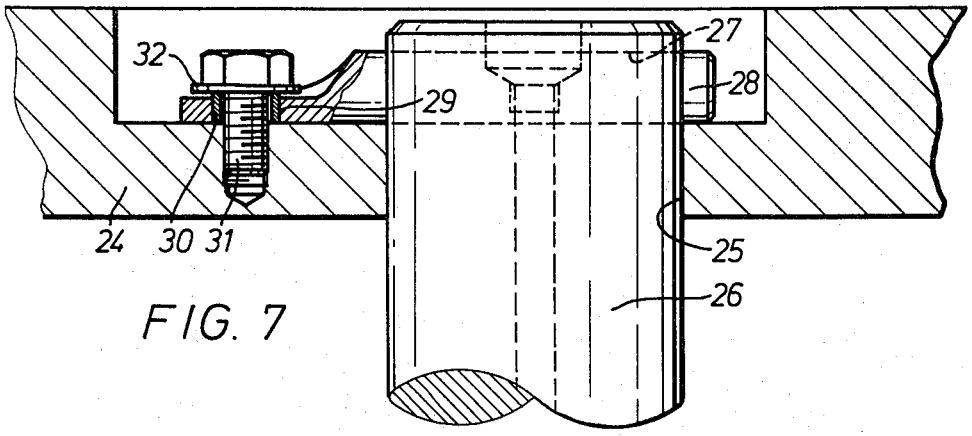
FIG. 7
FIG. 6
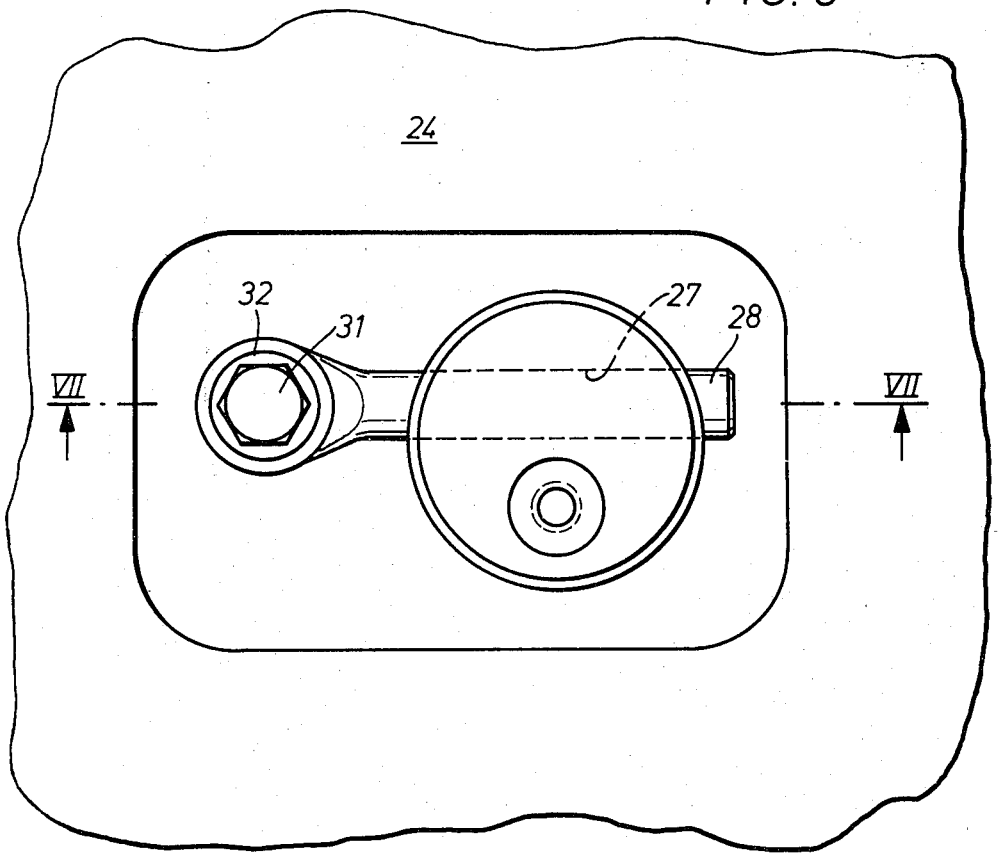

CLAMSHELL

This invention relates to a clamshell comprising a U-shaped halfscoop carrier, two halfscoops pivoted to the legs of the halfscoop carrier on axes which are parallel to each other and to the central crosspiece connecting the legs, and actuating levers, which are secured to the halfscoops and to which the piston rod and the cylinder, respectively, of a transversely extending hydraulic actuator are pivoted at the free ends of the levers.

For instance, in a clamshell of that kind which has been disclosed in German Early Disclosure 25 36 709, the levers for actuating the halfscoops are secured to the top edges of the sidewalls of the halfscoops. If the halfscoops do not uniformly close, for instance, because the forces which are exerted on the cutting edges and oppose the closing pressure vary over the length of the cutting edges or because the cutting edges are unsymmetrically loaded by stones or other items clamped between the cutting edges, then the halfscoops will be subjected to torsional stresses. For this reason they must be so thick that there will be no risk of damage in case of an unsymmetrical loading of the cutting edges. The use of thicker halfscoops will add to the costs as well as to the deadweight of the structure.

It is an object of the invention to provide a structurally simple and weight-saving clamshell which comprises torsionally rigid halfscoops.

In a clamshell of the kind described first hereinbefore this object is accomplished in that the tubes connecting the top edges of the side walls of the halfscoops are formed adjacent to their ends with radial slots extending over part of the periphery of the tubes, the end portions of the T-shaped legs are provided with the bearing bores and extend through said slots, and the side walls are formed with bores, which are aligned with the bores of the tubes and with the bearing bores and receive the pivot pins for the halfscoops.

Whereas the halfscoops of the clamshell according to the invention are relatively light in weight, they are torsionally rigid because the side walls of the halfscoops are connected by tubes which can well take up any torsional forces which may act on the side walls of the halfscoops and tend to twist them. On the other hand there are no parts which laterally protrude over the halfscoops which would restrict the field of application of the clamshell. Because in the clamshell according to the invention the legs carrying the halfscoops extend into radial slots in the tubes which connect the side walls of the halfscoops, the structure is torsionally rigid as the slots extending only over part of the periphery of the tubes do not appreciably reduce the resistance of the tubes to torsion. Besides, the pivot pins for the halfscoops are mounted in a simple manner on the inside surfaces of the side walls of the halfscoops so that said side walls define the width of the clamshell and there are no protruding parts.

The torsion-resisting tubes connecting the side walls of the halfscoops may have a larger wall thickness adjacent to their slots than in their midportion.

Rings corresponding to the pivot pins in diameter and adjoining the slots are suitably secured in the bores of the tubes.

To permit a fixation of discs connected to the pivot pins, the bores in the side walls may be larger in diameter than the bores of the rings and preferably also the bores of the tubes. The pivot pins can be held against rotation in a simple manner in that the bores in the side walls are eccentric with respect to the bores of the rings.

According to a preferred further feature of the invention the bearing bores are provided at the ends of crossbeams which in the middle of their length are secured to the ends of the U-shaped yoke. These beams are stressed substantially only in tension by the closing forces.

With the design according to the invention, the tubes may be provided with radial levers having forked ends, to which the actuators are pivoted. This will further simplify the structure and eliminate the need for additional parts that would add to the weight.

The tubes may be additionally provided with levers, which are pivoted at their ends to a link connecting them so that a four-bar linkage is provided, which ensures a uniform opening and closing of the half-scoops.

Figure 4:
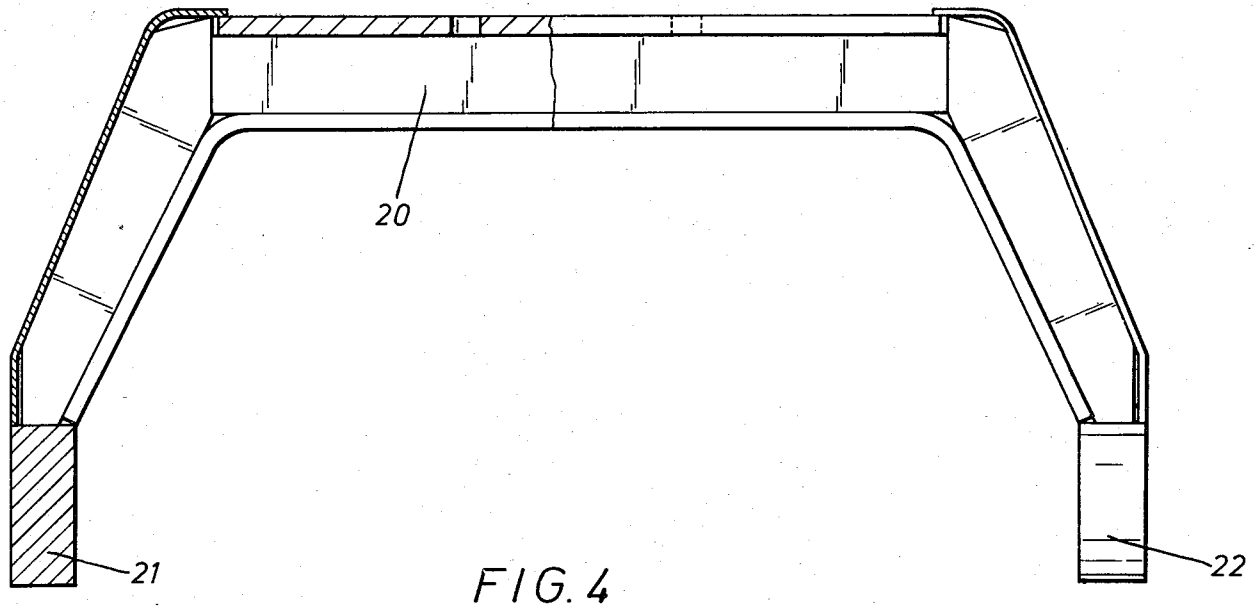
Figure 5:
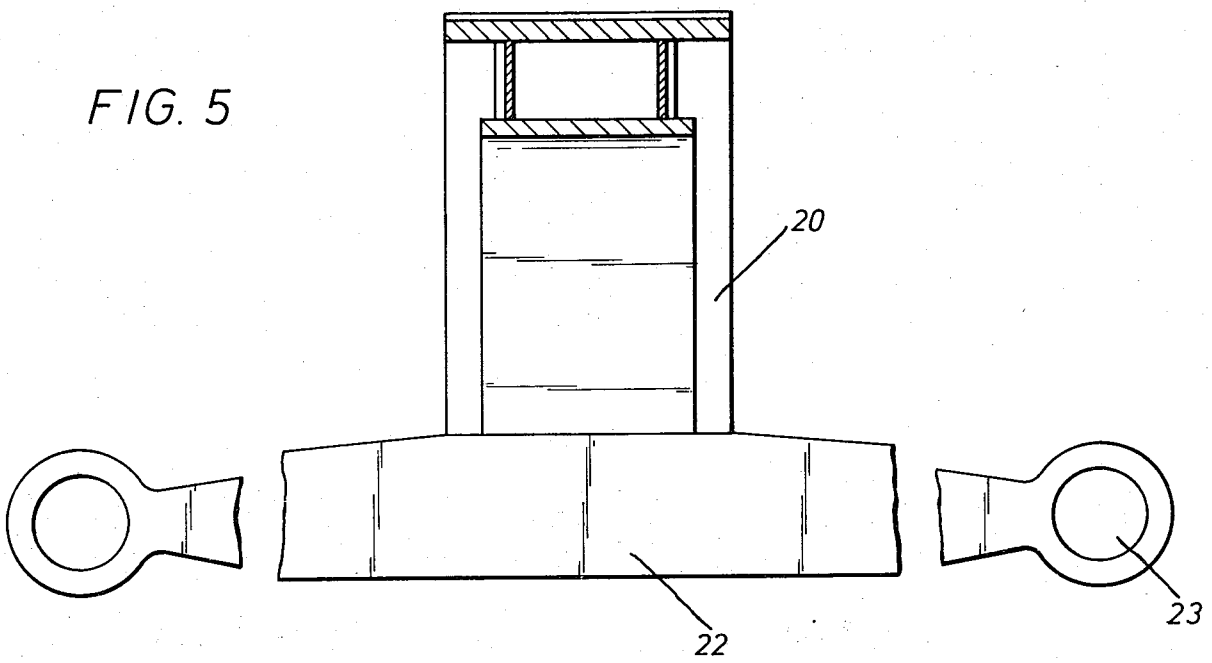

An illustrative embodiment of the invention will now be explained more fully with reference to the drawing, in which FIG. 1 is a transverse sectional view showing the halfscoops of a clamshell when closed, FIG. 2 is an elevation of the upper portion of a halfscoop viewed in the direction of the arrow A in FIG. 1 and shown partly in section, FIG. 3 is a sectional view taken on line III—III in FIG. 2 and showing the tube which connects the side walls of the halfscoops, FIG. 4 is a front elevation showing the carrier for the halfscoops, partly in section, FIG. 5 is a side elevation showing the carrier of FIG. 4, FIG. 6 is a top plan view showing another embodiment of means for locking the pivot pins which carry the halfscoops, and FIG. 7 is a sectional view taken on line VII—VII of FIG. 6 and showing the locking means.

The halfscoops 1, 2 in the assembled clamshell are pivoted to the halfscoop carrier shown in FIGS. 4 and 5 and are symmetrical so that only the right-hand halfscoop 1 will be explained more in detail hereinafter.

The halfscoop 1 comprises side walls 3, 3' and an arcuately curved bottom 5, which is welded to the lower edges of the side walls. The halfscoop 1 is provided with cutting edge members 6, 7 at those edges which face the other halfscoop 2. The cutting edge members 6, 7 are welded to the side walls and the bottom of the halfscoop.

The top edge portions of the side walls 3, 3' of the side walls are reinforced by plates 4, 4' joined by welding. The end faces of a tube 8 are welded to the inside surfaces of plates 4, 4'. The end portions of the tube 8 consist of tubular members 9, 9', which have a larger wall thickness than the midportion of the tube and have been welded to said midportion. The tubular members 9, 9' are formed with radial slots 10, 10', which have a circumferential angle of less than 180°. Rings 11, 12 adjoining the slots 10, 10' are contained in and welded to the tubular members 9, 9'. The rings 11, 12 have bores 13, in which the pivot pins 13*a* are mounted. Adjacent to the bores 13, the plates 4, 4' are provided with a bore 14, which is eccentric to the bore 13 and serves to receive a disk, which is joined to the pivot pin. The disk is held in position by being screwthreadedly connected to the tubular members 9, 9' or the rings 11, 12.

Levers 15, 16 are welded to the midportion of the tube 8 and at their ends have bearing bores 17. A hydraulic actuator 33 is disposed between the levers 15, 16 and its piston rod 34 and cylinder 35 are respectively pivoted to said levers at the free ends thereof.

Levers 18, 19 are welded to the tubes 8. A coupling link is pivoted to the ends of the levers 18, 19 and ensures that the halfscoops 1, 2 will be opened uniformly.

The halfscoop carrier shown in FIGS. 4 and 5 comprises a U-shaped yoke 20 and crossbeams 21, 22 welded to the legs of the yoke. The end portions of the crossbeams 21, 22 extend into the slots 10, 10' of the tubular members 9, 9' and are formed with bearing bores 23. The halfscoops 1, 2 are pivoted to the halfscoop carrier by pivot pins 13*a* and extend through the bearing bores 23 of the crossbeams 21, 22 and are held in the bores 13 of the rings 11, 12.

Another embodiment of the means for securing the pivot pins carrying the halfscoops and for locking them in position will now be explained more fully with reference to FIGS. 6 and 7.

The side plates 24 of the halfscoops are formed with bores 25, in which the pivot pins 26 are secured. The pivot pins 26 have an eccentric transverse bore 27, through which a locking pin 28 extends with a play. One end portion of the locking pin 28 is flattened and formed with a transverse bore 29. A bushing 30 is fitted in the transverse bore 29 and is forced against the plate 24 by means of the cap screw 31 and the interposed washer 32. The cap screw 31 is screwed into a tapped bore of the plate 24 so that the cap screw 31 cannot come loose unintendedly.

The locking pin 28 is held with play on the bushing 30, which is larger in height than the flattened portion of the locking pin 28 so that the latter has a play also in the axial direction of the bushing 30.

What is claimed is:

1. A clamshell comprising a U-shaped halfscoop carrier including a central crosspiece and depending side legs terminating in parallel crossarms having bearing bores formed proximate their ends, a pair halfscoops having side walls and swingable about parallel axes extending between corresponding end sections of said crossarms, an actuating lever secured to said halfscoops, a hydraulic actuator including a piston rod connected to one of said levers and a cylinder connected to the other of said levers, a tube having a bore and extending the upper border of each of said halfscoop sidewalls and having formed proximate its ends a slot extending for part of the periphery of the tube, the ends of each of said crossarms extending through respective slots with said bearing bores being in alignment with said bores in said tubes, said side walls having bores registering with the bores in said tubes and said crossarms, and pivot pins engaging said aligned crossarm bores and tube bores.

2. A clamshell according to claim 1, characterized in that the tubes have a larger wall thickness adjacent to said slots than in their midportion.

3. A clamshell according to claim 1 comprising rings having inside bearing bores corresponding to said pivot pins in diameter and adjoining said slots and secured in the bores of said tubes.

4. A clamshell according to claim 3 wherein the bores in the side walls are larger in diameter than the bores of the rings.

5. A clamshell according to claim 4 wherein the bores in the side walls are eccentric with respect to the bores in the rings.

6. A clamshell according to claim 1 wherein said crossarms comprise crossbeams which in the middle of their length are secured to the ends of said depending legs of said U-shaped carrier.

7. A clamshell according to claim 1 further comprising a second lever secured to and extending radially from each of said tubes and adapted to be intercoupled at their ends by a connecting link.

* * * * *